US007082888B1

(12) United States Patent
Al-Sabah

(10) Patent No.: US 7,082,888 B1
(45) Date of Patent: Aug. 1, 2006

(54) TAKE APART ANCHOR

(76) Inventor: Sabah Nasser Al-Sabah, P.B. 36777, Al-Ras (KW) 24758

( * ) Notice: Subject to any disclaimer, the term of this patent is extended or adjusted under 35 U.S.C. 154(b) by 0 days.

(21) Appl. No.: 11/214,457

(22) Filed: Aug. 29, 2005

Related U.S. Application Data

(60) Provisional application No. 60/605,619, filed on Aug. 30, 2004.

(51) Int. Cl.
*B63B 21/24* (2006.01)

(52) U.S. Cl. ..... 114/303; 114/298

(58) Field of Classification Search ..... 114/303, 114/294, 298, 301, 304, 306, 309, 307; D12/215
See application file for complete search history.

(56) References Cited

U.S. PATENT DOCUMENTS 3,774,569 A * 11/1973 Linnenbank ..... 114/303
4,651,669 A * 3/1987 Albertini et al. ..... 114/304
4,958,586 A * 9/1990 Stupakis ..... 114/297
5,868,094 A * 2/1999 Al-Sabah ..... 114/301

* cited by examiner

*Primary Examiner*—Jesus D. Sotelo
(74) *Attorney, Agent, or Firm*—Allen, Dyer, Doppelt, Milbrath & Gilchrist, P.A.

(57) ABSTRACT

A take apart anchor has a shank with an eye opening at its upper end adapted for connecting to a shackle and a pivot opening at its lower end adapted for receiving a mechanical fastener for attaching the shank to a stock. The stock has two wings extending away from each other at an angle, the upper surface of the wings including a plurality of bosses, and having an opening through which the lower end of the shank extends. A plurality of fluke plates is connected to the stock by being removably engaged with the plurality of bosses, each fluke plate of the plurality having a base and at least one fluke extending from the base. A plurality of grappling or finger members extends upwardly from the stock and from each individual fluke plate of the plurality of fluke plates, each individual finger member of the plurality being detachably connected by a removable mechanical fastener.

20 Claims, 12 Drawing Sheets

TAKE APART ANCHOR

RELATED APPLICATION

This application claims priority from co-pending provisional application Ser. No. 60/605,619 which was filed on Aug. 30, 2004, and which is incorporated herein by reference in its entirety.

FIELD OF THE INVENTION

The present invention relates to the anchoring devices for marine vessels and other aquatic floating objects and, more particularly, to an anchor which may be taken apart of easy storage or shipping, and its associated methods.

BACKGROUND OF THE INVENTION

Marine vessels and other floating objects, such as buoys, typically require some anchoring device or method for remaining relatively stationary when stopped upon the water. Many types of anchors have been developed and used throughout the centuries. The simplest of these were heavy weights, such as large stones, connected to the vessel by a rope. Modern vessels employ metal anchors that include projections known as flukes and other structural features intended for engaging underwater obstacles or for digging the anchor into the bottom. The heavy and many times complicated structure of most anchors makes it difficult to compactly stow or transport anchors when not deployed for use on a vessel. On a smaller vessel, an anchor that can be easily disassembled may be the ideal solution to the stowage problem. Another problem arises in sandy areas where there is minimal outcropping of rock whereon an anchor may be fixed. The present invention addresses this problem by providing a large fluke surface for engaging soft or sandy bottoms and grappling members which extend at a different angle than the flukes. A pivoting shank addresses the seabed at various angles to aid in affixing the anchor therein.

SUMMARY OF THE INVENTION

With the foregoing in mind, the present invention advantageously provides a take apart anchor. The present anchor is easily disassembled so that it may be stored in less space or so that it may be more conveniently shipped. The anchor is easy to put together in relatively very little time.

The present take apart anchor comprises a stock, two detachable flukes, a shank, and a plurality of grappling members. The stock has an angled support plate with a ridge defining two portions of the plate. There is a plurality of bosses on an upper side on a first portion of the plate and a second plurality of bosses on an upper side of a second portion of the plate. Two fluke plates are detachably connected to the stock by having complementary openings on the fluke plates engaged with the plurality of bosses on the stock. A shank is pivotally connected to a medial portion of the stock. A plurality of grappling pins is detachably connected to and extending outwardly from upper surfaces of the stock.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
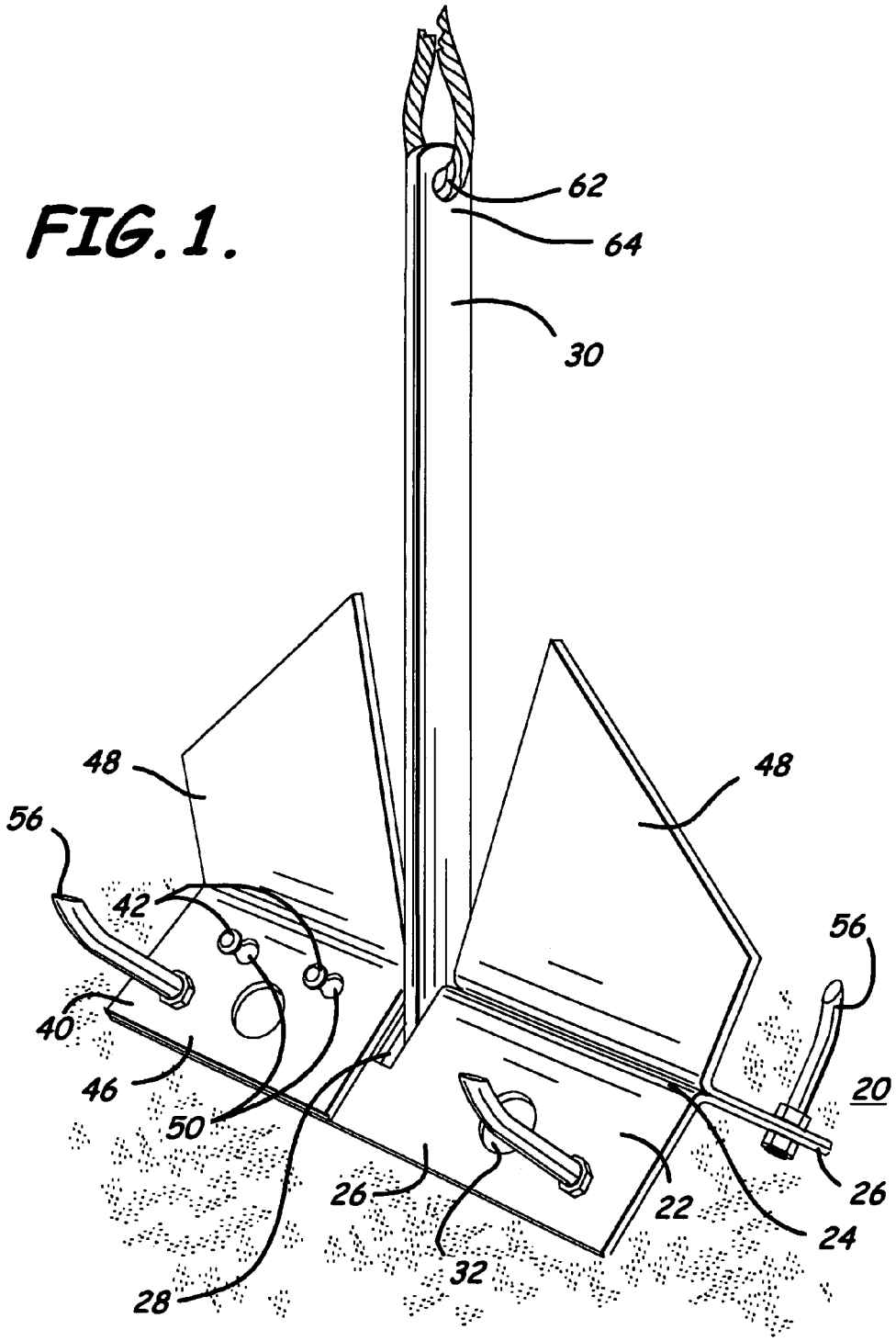
FIG. 1 shows a frontal environmental perspective view of a fully assembled anchor that is ready for use according to an embodiment of the present invention.
Figure 2:
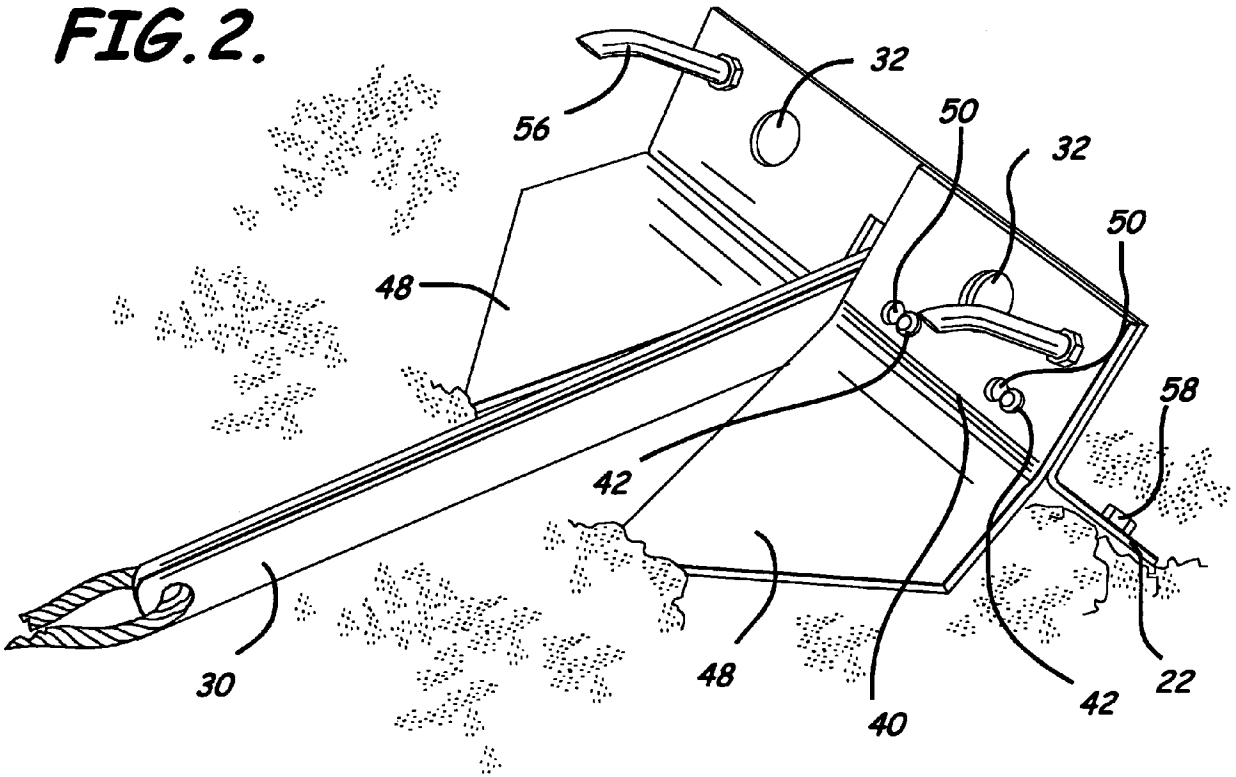
FIG. 2 is an environmental perspective view of the anchor of FIG. 1, illustrating how the flukes may engage a soft or sandy bottom.
Figure 3:
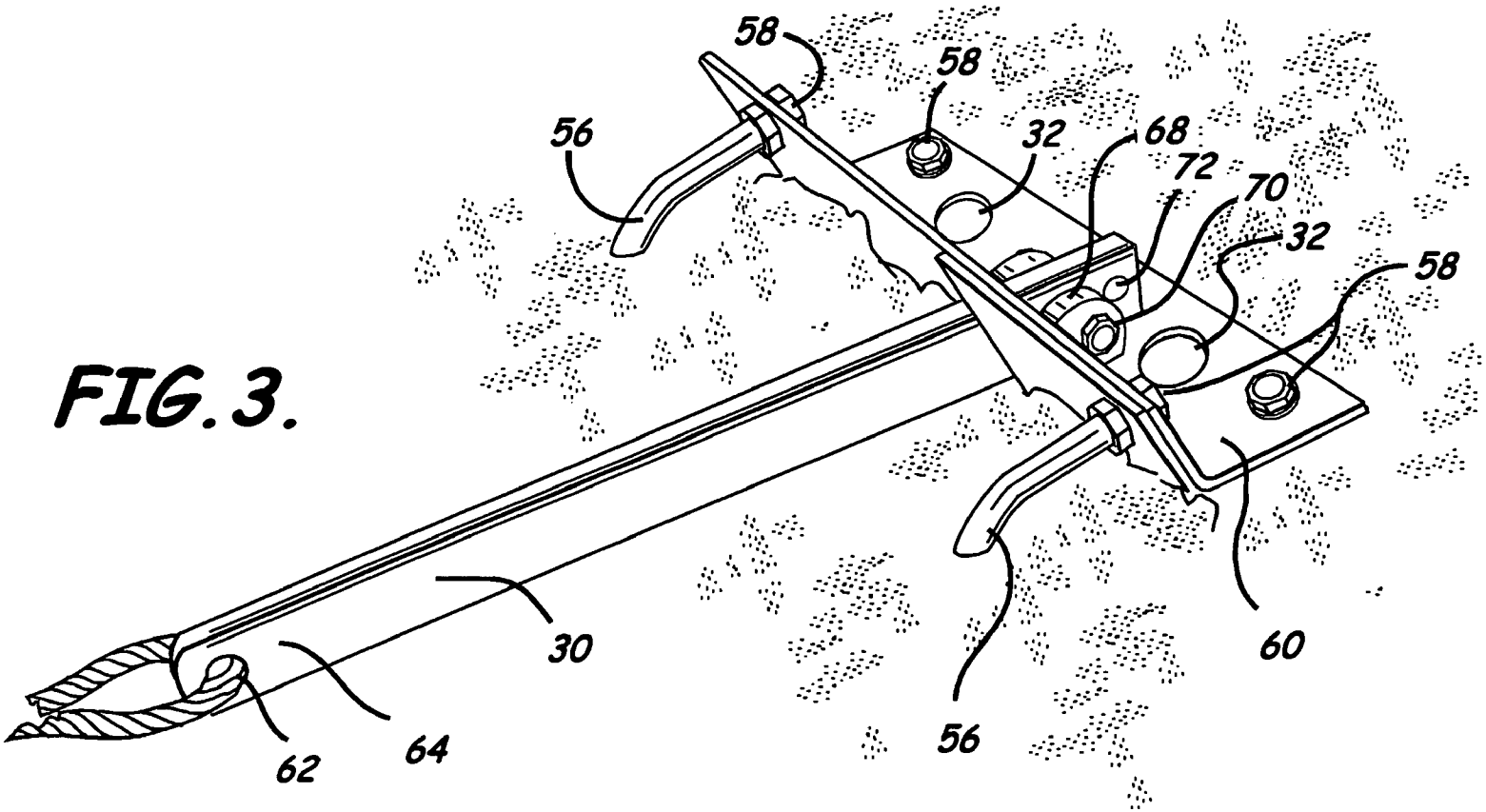
FIG. 3 is an environmental perspective view of the present anchor depicting the depth of bottom penetration that may be achieved.
Figure 4:
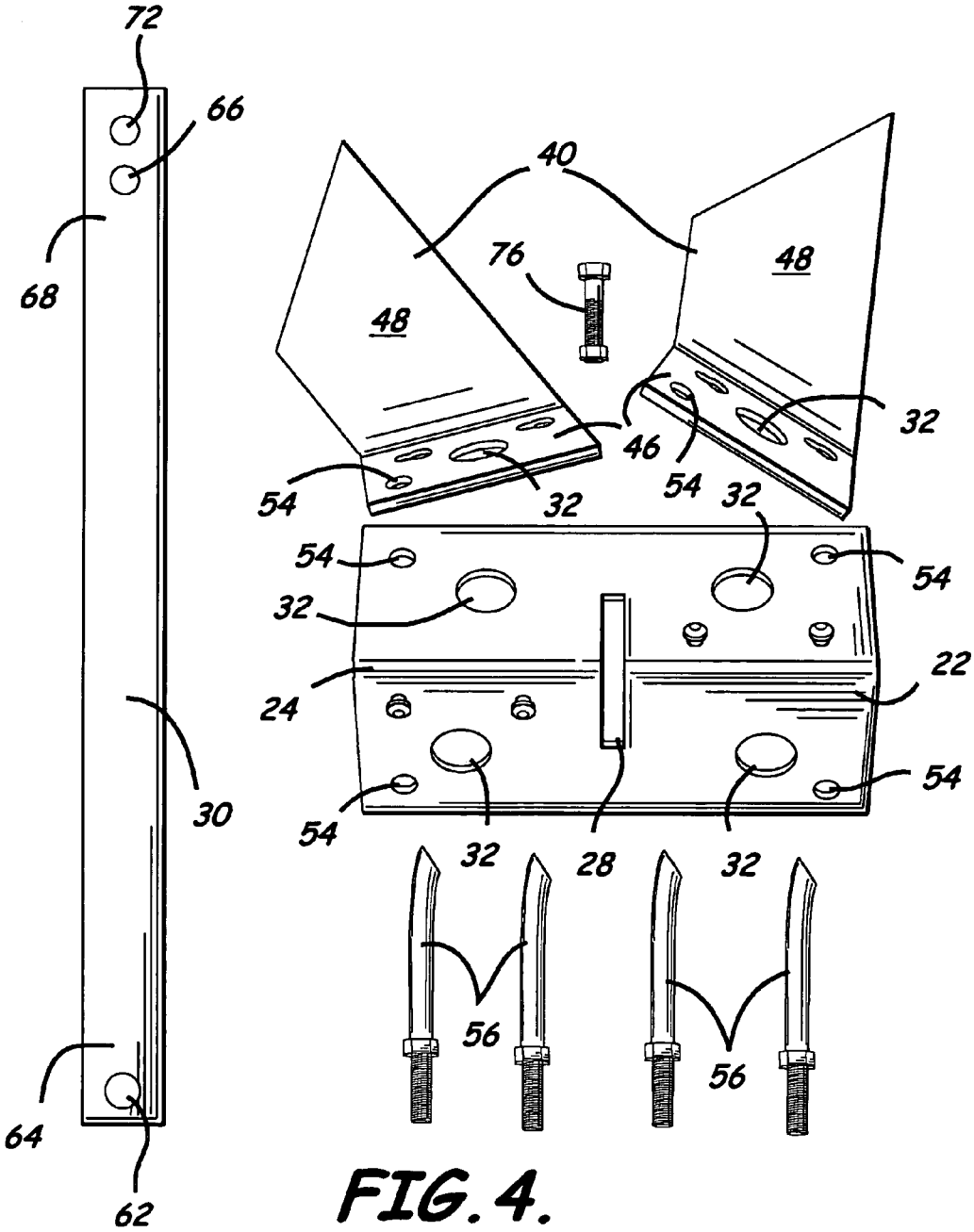
FIG. 4 is a front elevational view of each of the main components of the anchor of FIG. 1 in their disassembled state.
Figure 5:
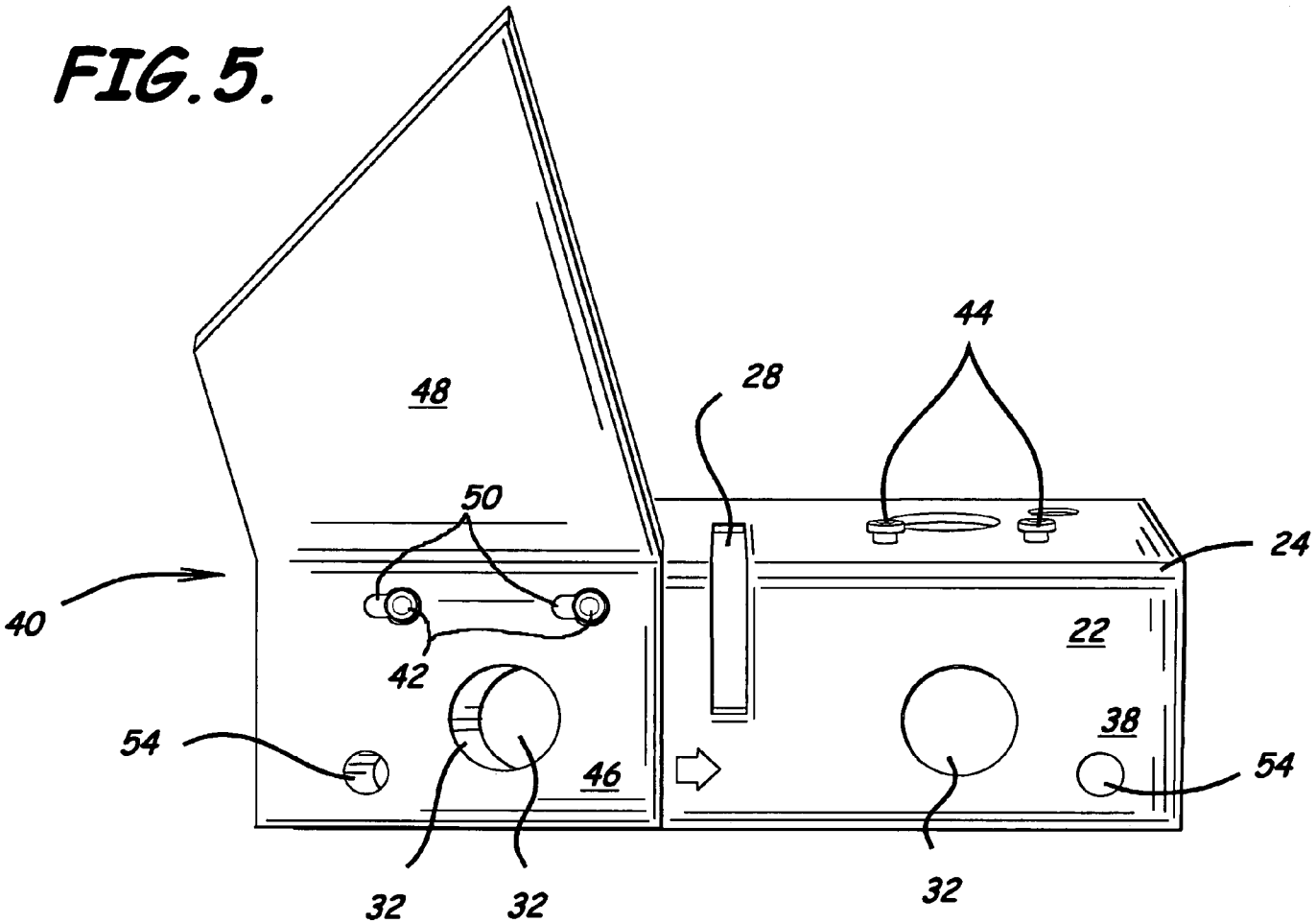
FIG. 5 is a front elevational view of the present invention showing engagement of a first fluke plate with two bosses on an upper side of the stock.
Figure 6:
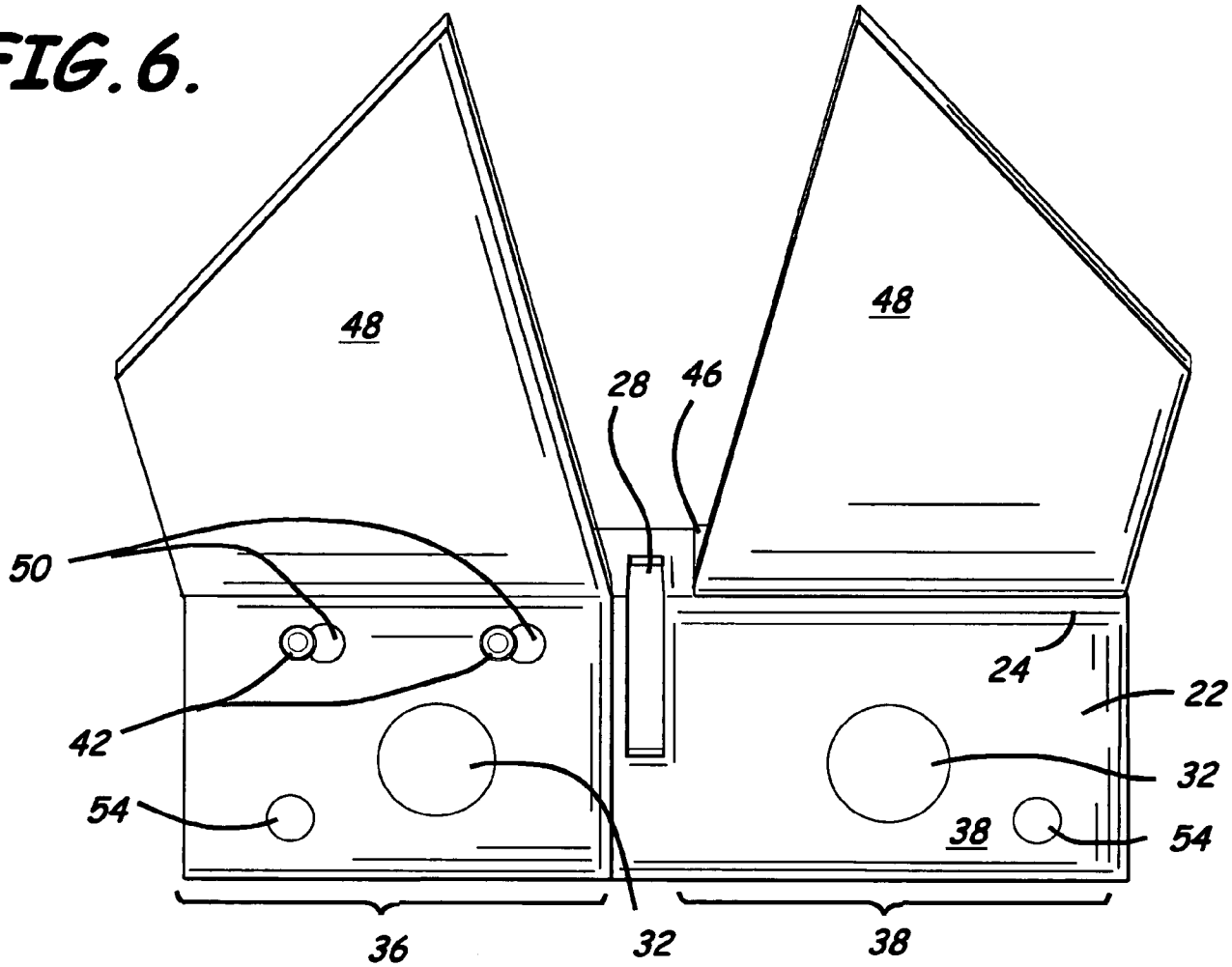
FIG. 6 is a front elevational view of a second fluke plate of the present anchor having engaged bosses on a stock.
Figure 7:
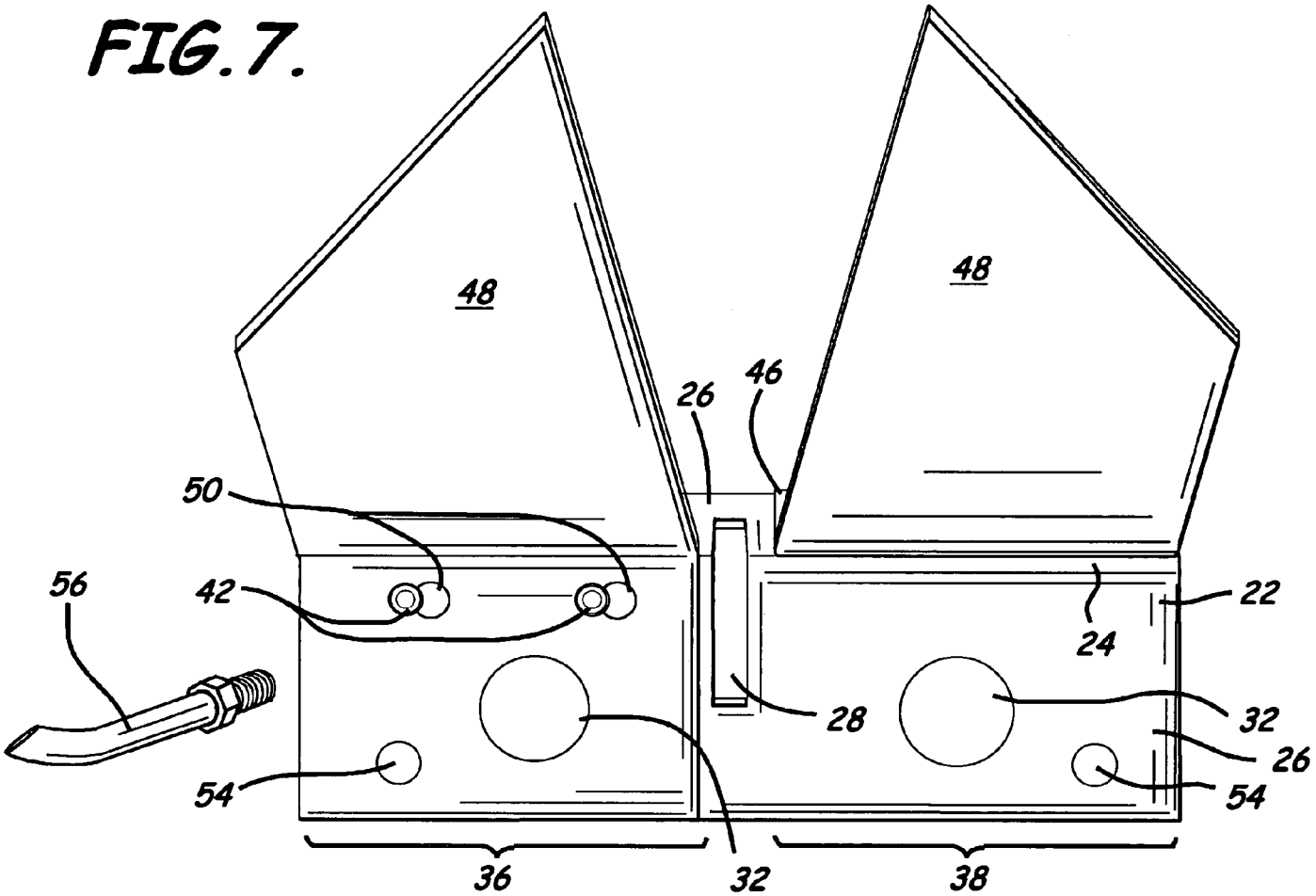
FIG. 7 is a front elevational view of the anchor of FIG. 1, showing a first grappling member being aligned with complementary openings on the stock and the base of a first fluke plate.
Figure 8:
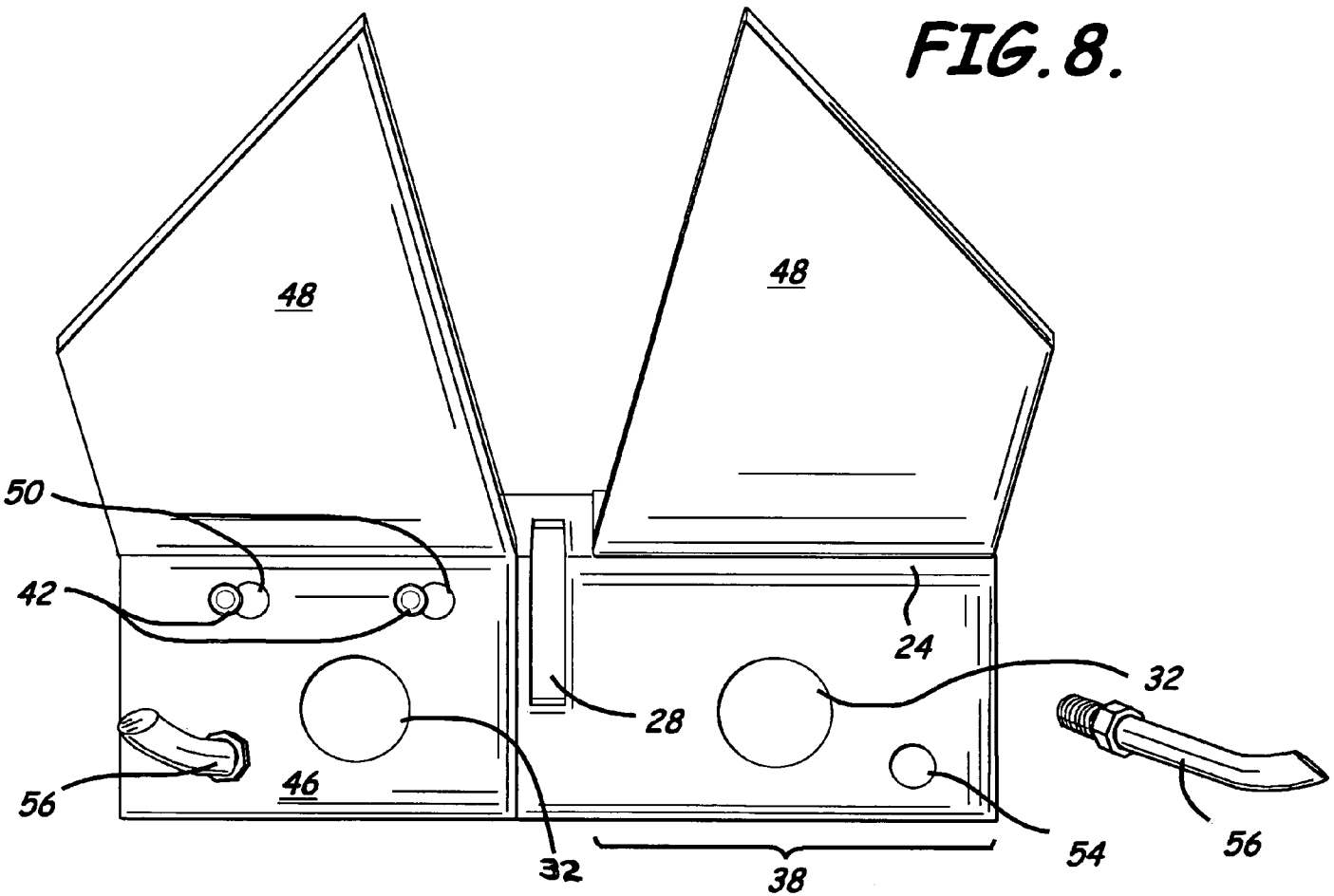
FIG. 8 is a front elevational view of the present anchor, showing another grappling member being aligned with complementary opening on the stock only to assemble the anchor.
Figure 9:
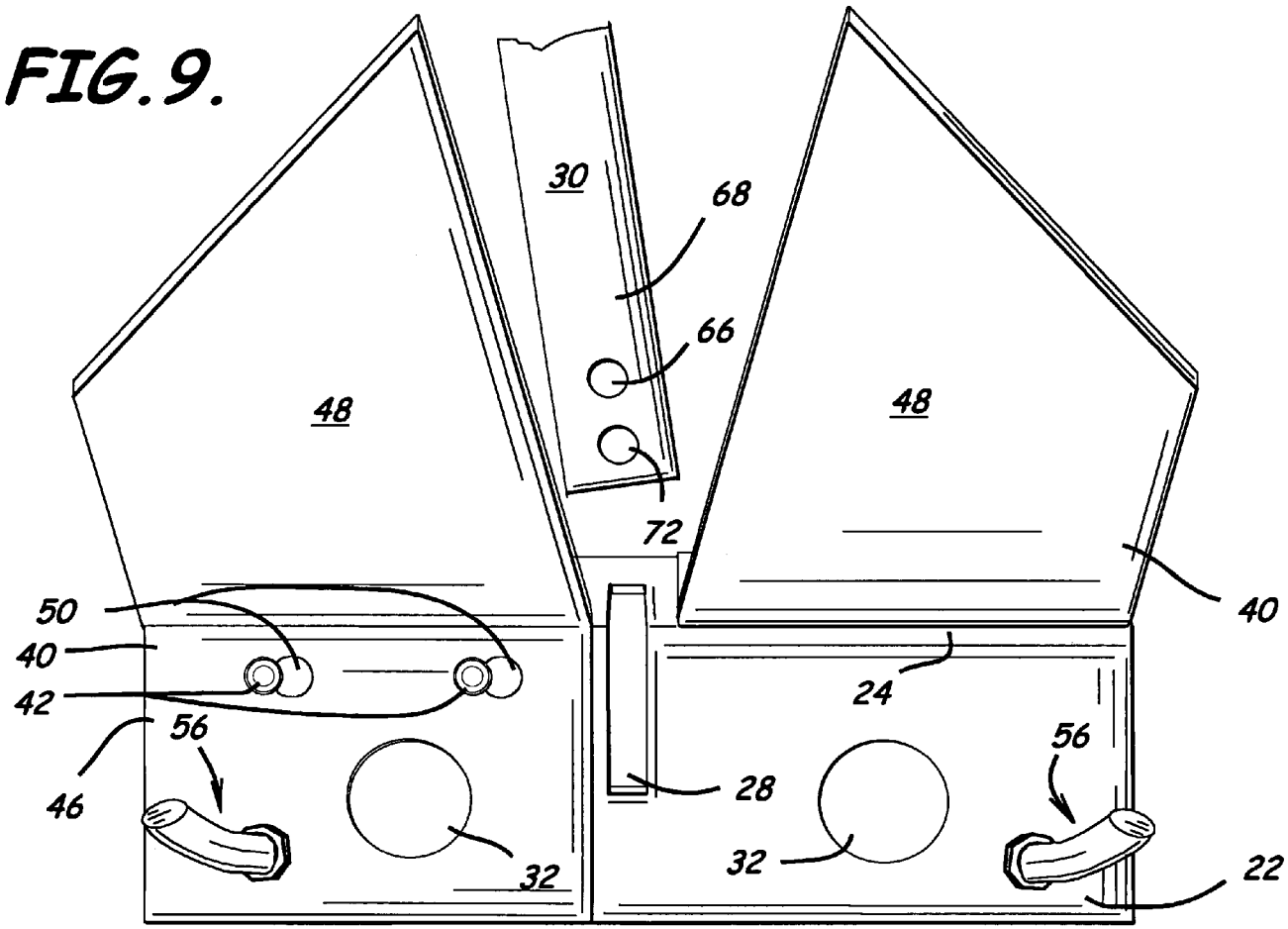
FIG. 9 is a front elevational view of the shank with two openings on its lower end being aligned with slotted opening on the stock to assemble the present anchor.
Figure 10:
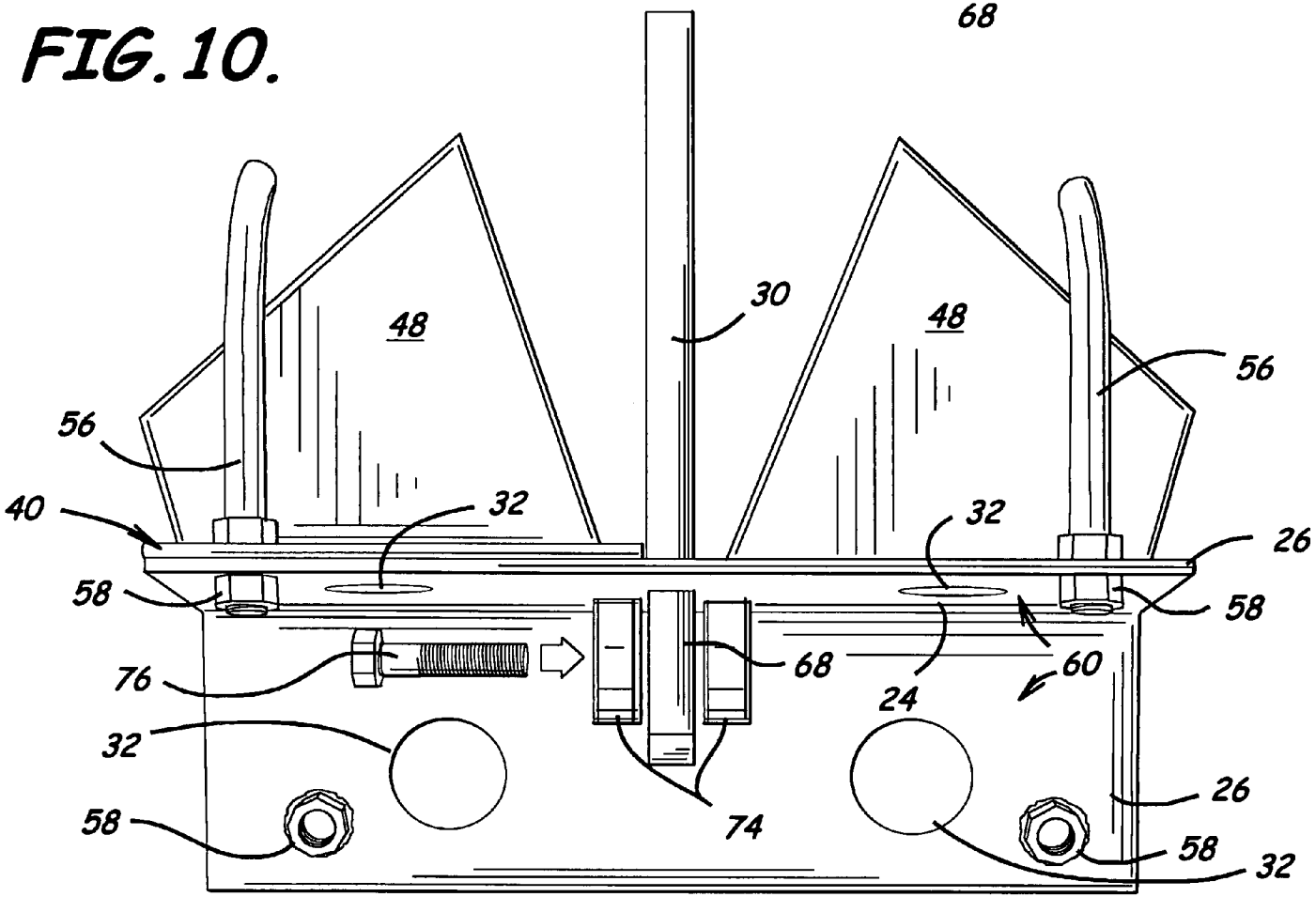
FIG. 10 is a front elevational view of a lower end of the shank of the present anchor being aligned with a hinge on the underside of the stock to assemble the anchor.

FIG. 1 depicts a frontal environmental perspective of a fully assembled anchor 20 according to the present invention, as it is ready for use. FIGS. 2 and 3 provide perspective environmental views of the anchor as it is used for tethering a boat or other buoyant device or vessel in sandy sails. As illustrated, the anchor may advantageously be used for multiple purposes in various underwater terrains, however, it is particularly well suited for soft or sandy bottoms wherein other anchors may typically have difficulties engaging and remaining firmly fixed therein.

Figure 11:
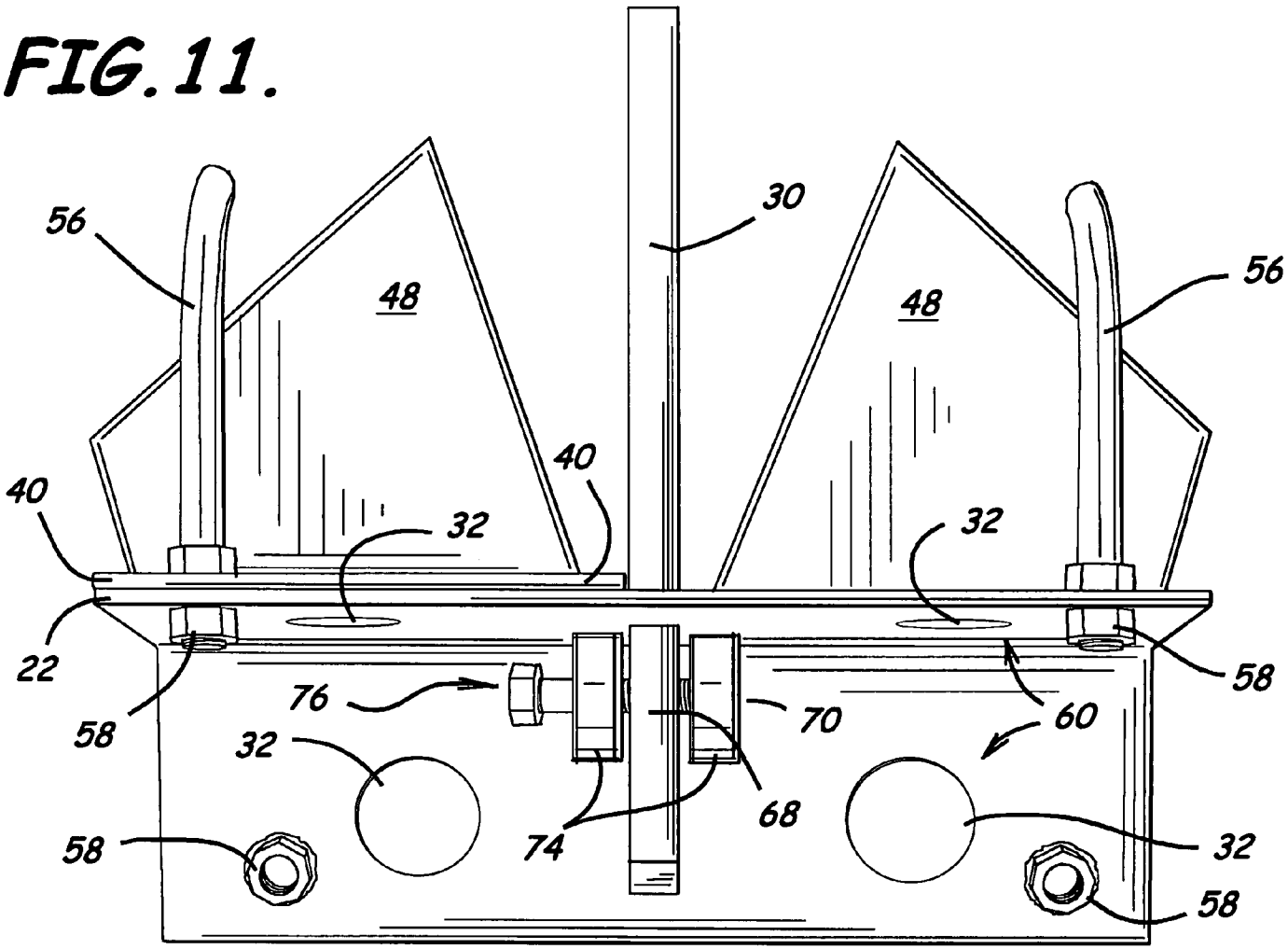
FIG. 11 is a front elevational view of the anchor of FIG. 1, showing a metal fastener engaging the hinge and an opening in the lower end of the shank aligned with a hinge on the stock during anchor assembly.
Figure 12:
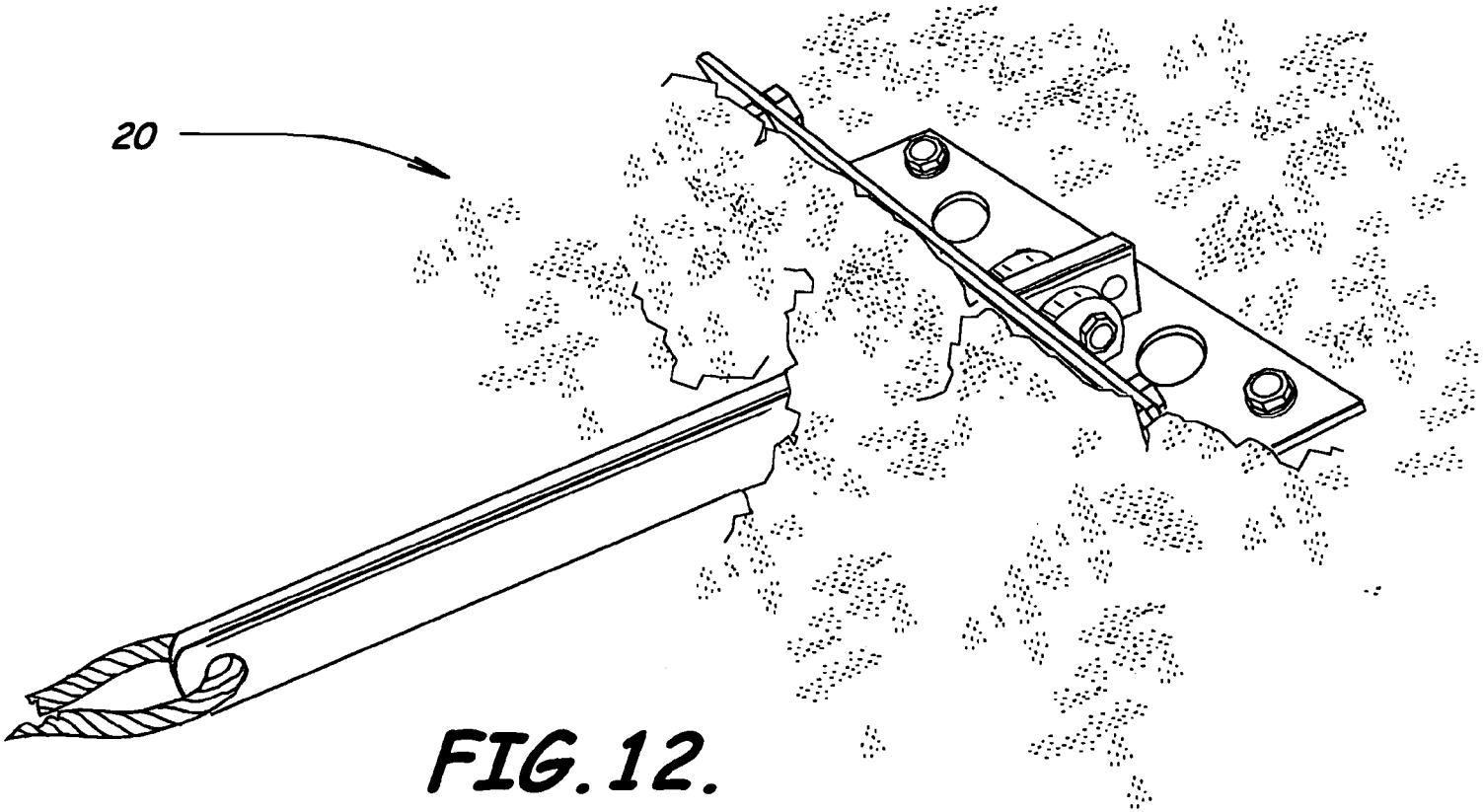
FIG. 12 shows the anchor of FIGS. 1 and 2 buried in a soft bottom in response to the pull of a vessel on the anchor line and chain attached thereto.

FIGS. 4–12 show various views of the structural components of the present take apart anchor, the components and their assembly being more fully discussed below with specific reference to their part numbers. Those skilled in the art of seamanship will recognize that regardless of anchor design, it is of great importance that a vessel's anchoring system, also known as ground tackle, include a sufficient length of adequately sized chain. The chain, with its accompanying weight, ensures that the final length of the anchor line lies relatively parallel to the bottom so that the vessel's pull on the anchor tends to be more horizontal than vertical. It is this relatively horizontal pull which helps a properly designed anchor to dig into the bottom, whereas if the pull is mostly vertical the anchor will fail to dig in and will drag on the bottom. As shown in FIG. 12, the present anchor will bury itself in the bottom when subject to a relatively horizontal pull, as discussed above.

The anchor 20 has a stock 22 preferably made of an elongated angled plate having a vertex forming a ridge 24 extending approximately along a center length of the plate, wherein the bend in the plate defines the ridge 24 as illustrated, forming two wings 26 which extend away from each other at an angle and forming first and second upper sides positioned opposite each other relative to the ridge.

The stock 22 has an opening 28 along its ridge so that the lower end 29 of shank 30 can extend through the opening and be pivotally connected on the underside of the stock. In one embodiment, the opening 28 along the ridge 24 of the stock extends approximately perpendicular to the vertex and creates a slot. As will be described further herein, this opening forms part of the positioning mechanism for the anchor 20 that allows it to adaptively position the anchor in various orientations, depending on the underwater terrain. This configuration has the advantage of allowing the anchor 20 to align its flukes at whatever vector angle that results in an effective combination of horizontal and vertical forces that will allow the anchor to grip either on an underwater obstacle or in the bottom, depending upon the conditions the anchor may encounter when it is used.

In addition to the opening 28 on the ridge 24, FIG. 3 shows that the stock 22 has openings 32 on each of its sides that allow at least some water and bottom material to pass through the stock. These openings advantageously allow the anchor 20 to fall faster in water and to better engage soil surfaces. A set of smaller openings 54 is for connecting a plurality of grappling members to the stock.

In a preferred embodiment of the invention, the location of the ridge opening 28 suggests a first half 36 and a second half 38 on the upper side of each of the wings. Each wing 26 on the stock has first half 36 that has a first plurality of bosses 42 positioned on a first half of the first upper side and a second plurality of bosses 44 positioned on a second half of the second upper side. These sets of bosses are used to connect fluke plates 40 to the stock 22 during assembly and to hold the flukes in contact and in their preferred alignment with the stock. Preferably, each plurality of bosses 42, 44 comprises at least two bosses positioned on the first half 36 of the first upper side and at least two bosses positioned on a second half 38 of the second upper side.

When assembling the anchor, a first and a second fluke 40 are connected to the stock 22 individually. Each fluke plate 40 has a base 46 and at least one fluke tine 48 extending at an angle from the base. In a preferred embodiment, the first and second fluke tines 48 are shaped as trapezoids, although those skilled in the art will recognize that for different applications multiple tines or other geometries may also be employed and are intended to be within the scope of the invention.

The first fluke plate 40 is connected to the stock 22 when its base 46 abuts one of the wings 26 of the stock. The first fluke plate base 48 has a plurality of openings 50 complementary to the plurality of bosses 42 on the first half of the first upperside of the stock. Most preferably, the plurality of openings 50 on the first fluke plate 40 is equal in number to the number of bosses 42 positioned on the first half of the first upper side 36 of the stock. In one embodiment, the first fluke plate openings 50 fit over the bosses and are slidably engaged therewith. The second fluke plate openings 52 fit over the bosses on the second half of the second upper side 38 of the stock and are slidably connected thereto. Again, most preferably, the plurality of openings 50 on the second fluke plate 44 is equal in number to the number of bosses 44 positioned on a second half of the second upper side 38. This action joins the fluke plates 40 to the stock 22; however, this connection becomes more secure as each grappling member is added.

The stock 22 and the bases 46 of the first and second fluke plates each have a plurality of complementary openings 54 that align so that individual grappling members 56 may be inserted therethrough. A first grappling member 56 extends from a second half of the first upper side of the stock and generally opposite relative to the ridge from the plurality of bosses positioned on the second upper side of the stock. A second grappling member extends from a first half of the second upper side of the stock and generally opposite relative to the ridge from the plurality of bosses positioned on the first upper side of the stock.

FIG. 1 illustrates four grappling members that are connected to the stock. In one embodiment of the present invention, the grappling members 56 are finger members; in another embodiment, the grappling members may be hooks. Those skilled in the art will recognize the geometry of the grappling members 56 may be straight or curved in any manner that achieves the proper distribution of the vector forces 40 complement the gripping force exerted by the flukes. Accordingly, grappling members of any effective shape are intended to be within the scope of the invention. Once inserted through the opening in the stock 54 or through the complementary openings in the fluke plates, each of the grappling members 56 is fastened into place by at least one fastener 58 that secures the grappling member to the stock. In a preferred embodiment of the invention, the grappling member includes at least a threaded portion and the fastener 58 is at least one nut which is permanently attached to the underside 60 of the stock and which is complementary to the threaded portion on the grappling member.

Once the grappling members 56 are secured, the shank 30 is then connected to the stock 22. The shank 30 preferably has at least one eye opening 62 at an upper end 64 adapted for connecting to a chain shackle and a pivot opening 66 at a lower end 68 adapted for therethrough receiving a mechanical fastener 70. In one embodiment, the shank has an optional third opening 72 positioned at its lower end 68 and adapted for therethrough tying a line, as an aid in retrieving the anchor when it is stuck on the bottom by providing pull in a different direction.

In another preferred embodiment, the shank 30 is pivotally attached to the stock 22 by inserting the lower end 68 through the stock ridge opening 28 and engaging pivot opening 66 with the mechanical fastener 70 located on the underside 60 of the stock. The mechanical connector 70 is used to secure the shank 30 to the stock 22. As shown in FIG. 11, the mechanical connector 70 may include a hinge 74 and a pin 76 that allow the shank 30 to pivot about a longitudinal axis of the mechanical connector through an arc of at least approximately 70 degrees. The mechanical fastener is preferably a threaded connector, such as a bolt.

Accordingly, in the drawings and specification there have been disclosed typical preferred embodiments of the invention and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as recited in the appended claims.

What is claimed is:

1. An anchor comprising:

a shank having a first opening positioned at an upper end, and a second opening positioned at a lower end;

a stock consisting of an elongated angled plate having a vertex forming a ridge extending approximately along a center length of the plate, having an opening along the ridge with the lower end of said shank extending therethrough, having first and second upper sides positioned opposite each other relative to the ridge, each upper side having a first half and a second half, a first plurality of bosses being positioned on a first half of the first upper side and a second plurality of bosses being positioned on a second half of the second upper side;

a mechanical connector engaged in said shanks second opening along an underside of the angled plate, pivotally securing said shank to said stock;

a first grappling member extending from a second half of the first upper side of the stock and generally opposite relative to the ridge from the plurality of bosses positioned on the second upper side of the stock;

a second grappling member extending from a first half of the second upper side of said stock and generally opposite relative to the ridge from the plurality of bosses positioned on the first upper side of said stock;

a first fluke having a base and at least one fluke tine extending at an angle from the base, the base abutting the first half of the first upper side of said stock and having a plurality of openings complementary to the plurality of bosses thereon and detachably engaged therewith, the base further having a first fluke grappling member extending outwardly therefrom and spaced apart from the plurality of openings; and a second fluke having a base and at least one fluke tine extending at an angle from the base, the base abutting the second half of the second upper side of said stock and having a plurality of openings complementary to the plurality of bosses thereon and detachably engaged therewith, the base further having a first fluke grappling member extending outwardly therefrom and spaced apart from the plurality of openings.

2. The anchor of claim 1, wherein said shank has a third opening positioned at the lower end.

3. The anchor of claim 1, wherein the opening along the ridge of said stock extends approximately perpendicularly to the vertex.

4. The anchor of claim 3, wherein said shank pivots about a longitudinal axis of said mechanical connector through an arc of at least approximately 70 degrees.

5. The anchor of claim 1, wherein said mechanical connector comprises a hinge.

6. The anchor of claim 1, wherein said mechanical connector further comprises a pin.

7. The anchor of claim 1, wherein the plurality of bosses further comprises at least two bosses positioned on the first half of the first upper side and at least two bosses positioned on a second half of the second upper side.

8. The anchor of claim 1, wherein the plurality of openings on said first fluke plate is equal in number to the number of bosses positioned on the first half of the first upper side of said stock and the plurality of openings on said second fluke plate is equal in number to the number of bosses positioned on a second half of the second upper side of said stock.

9. The anchor of claim 1, wherein said stock has a plurality of openings and where the bases of said first and second fluke plates each has a plurality of complementary openings which align with the plurality of openings in said stock.

10. The anchor of claim 1, wherein said first and second fluke tines are shaped as trapezoids.

11. The anchor of claim 1, wherein said grappling members further comprise hooks.

12. The anchor of claim 1, wherein each of said grappling members further comprises at least one nut securing the grappling member to the stock.

13. The anchor of claim 12, wherein at least one nut is permanently attached to the underside of said stock.

14. A take apart anchor comprising:

a stock having an angled support plate with a ridge defining two portions of the plate, a plurality of bosses on an upper side on a first portion of the plate and a second plurality of bosses on an upper side of a second portion of the plate;

two fluke plates detachably connected to said stock by having complementary openings on said fluke plates engaged with the plurality of bosses on said stock, a shank pivotally connected to a medial portion of said stock; and a plurality of grappling pins detachably connected to and extending outwardly from upper surfaces of said stock.

15. A take apart anchor comprising:

a shank having at least one eye opening at an upper end adapted for connecting to a shackle and a pivot opening at a lower end adapted for therethrough receiving a mechanical fastener;

a stock having two wings extending away from each other at an angle, having an upper surface including a plurality of bosses, an having an opening through which the lower end of said shank extends, said shank being detachably connected to said stock by said mechanical fastener;

a plurality of fluke plates connected to said stock by being removably engaged with the plurality of bosses, each fluke plate of the plurality having a base and at least one fluke extending from the base; and a plurality of finger members extending upwardly from said stock and from each individual fluke plate of said plurality of fluke plates, each individual finger member of the plurality being detachably connected by a removable mechanical fastener.

16. The take apart anchor of claim 15, wherein the shank has a second eye opening positioned at the lower end and adapted for therethrough tying a line.

17. The take apart anchor of claim 15, wherein a slotted opening is positioned across a ridge formed at a vertex of the two wings to permit the lower end of said shank to extend therethrough.

18. The take apart anchor of claim 15, wherein said mechanical fastener further comprises a pin.

19. The take apart anchor of claim 15, wherein the plurality of bosses includes at least two bosses positioned on the first half of the first upper side and at least two bosses positioned on a second half of the second upper side.

20. The take apart anchor of claim 15, wherein the plurality of openings on the first fluke plate is equal in number to the number of bosses positioned on the first half of the first upper side of the stock and the plurality of openings on the second fluke plate is equal in number to the number of bosses positioned on a second half of the second upper side.

* * * * *